US008720527B1

(12) United States Patent
Shepherd et al.

(10) Patent No.: US 8,720,527 B1
(45) Date of Patent: May 13, 2014

(54) METHOD FOR MANUFACTURING A CAST PRODUCT HAVING A PHOTOGRAPHIC RELIEF IMAGE; AND, CAST PRODUCT

(75) Inventors: Samuel Emerson Shepherd, Sauk Centre, MN (US); Chad David Althaus, Melrose, MN (US)

(73) Assignee: Cold Springs Granite Company, Cold Springs, MN (US)

( * ) Notice: Subject to any disclaimer, the term of this patent is extended or adjusted under 35 U.S.C. 154(b) by 0 days.

(21) Appl. No.: 13/429,389

(22) Filed: Mar. 25, 2012

Related U.S. Application Data

(60) Provisional application No. 61/467,702, filed on Mar. 25, 2011.

(51) Int. Cl.
*B22C 7/00* (2006.01)

(52) U.S. Cl.
USPC ..... 164/45; 164/4.1; 164/235

(58) Field of Classification Search
USPC ..... 164/4.1, 6, 45, 235; 700/118
See application file for complete search history.

(56) References Cited

U.S. PATENT DOCUMENTS

| | | | |
|---|---|---|---|
| 4,054,000 | A | 10/1977 | Lisle |
| 4,126,500 | A | 11/1978 | Palanos |
| 4,254,544 | A | 3/1981 | Barker |
| 498,506 | A | 5/1983 | Cameron |
| 4,676,997 | A | 6/1987 | LaFay et al. |
| 5,363,609 | A | 11/1994 | Hancovsky |
| 5,714,367 | A | 2/1998 | Quick et al. |
| 5,926,388 | A | 7/1999 | Kimbrough et al. |
| 6,173,539 | B1 | 1/2001 | Barnes |
| 6,363,635 | B1 | 4/2002 | England |
| 6,385,499 | B1 | 5/2002 | Mattke et al. |
| 6,459,952 | B1 | 10/2002 | Dundorf |
| 6,605,797 | B1 | 8/2003 | Troitski |
| 6,843,303 | B2 | 1/2005 | Siak et al. |
| 6,950,713 | B2 | 9/2005 | Walthall |
| 7,141,207 | B2 | 11/2006 | Jandeska et al. |
| 7,814,959 | B2 | 10/2010 | Karenbauer |
| 2003/0019135 | A1 | 1/2003 | Luckenbaugh |
| 2005/0011151 | A1 | 1/2005 | Koeper |

(Continued)

FOREIGN PATENT DOCUMENTS

| | | |
|---|---|---|
| CN | 101046123 | 10/2007 |
| WO | WO 2007/022378 | 2/2007 |

OTHER PUBLICATIONS

Relief, http://en.wikipedia.org/wiki/Bas-relief retrieved Feb. 23, 2011 (9 pages).

(Continued)

*Primary Examiner* — Kevin P Kerns
(74) *Attorney, Agent, or Firm* — Merchant & Gould, P.C.

(57) ABSTRACT

A method for manufacturing a cast product having a photographic relief image thereon is disclosed. The method includes steps of capturing a photographic image as a digital grayscale image, converting the digital grayscale image to a series of instructions for operating a laser engraving machine; laser engraving a pattern material to provide a pattern having a photographic relief image therein corresponding to the digital grayscale image and having a relief depth of about 0.030 inch to about 0.080 inch, wherein the relief depth refers to the maximum relief distance within the photographic relief image, and wherein the photographic relief image exhibits a true resolution corresponding to at least about 80 dpi; creating a mold cavity in sand using the laser engraved substrate; and casting a metallic material in the mold cavity to provide a cast product having the photographic relief image therein.

12 Claims, 2 Drawing Sheets

(56) References Cited

U.S. PATENT DOCUMENTS

| | | | |
|---|---|---|---|
| 2005/0038547 | A1 | 2/2005 | Walthall |
| 2007/0039707 | A1 | 2/2007 | Karenbauer |
| 2008/0148539 | A1 | 6/2008 | Shepherd et al. |
| 2008/0154413 | A1 | 6/2008 | Proudfoot |
| 2008/0160254 | A1 | 7/2008 | Arnold |
| 2009/0212029 | A1 | 8/2009 | Ellis et al. |
| 2010/0247867 | A1 | 9/2010 | Yoshida |

OTHER PUBLICATIONS

Laser engraving, http://en.wikipedia.org/wiki/Laser_engraving retrieved Feb. 23, 2011 (8 pages).
Kern http://www.kernlasers.com/3d_laser_engraving.htm, 2 pages.
Gantry Gallery Graygraphics http://gantryco.com/index.htm, 2 pages.
User's Manual HSE High Speed Engraving. Dec. 15, 2010, 96 pages.
U.S. Appl. No. 11/642,137, filed Dec. 20, 2006.
ArtCAM Pro Tutorials, Delcam plc, Mar. 24, 2004, 290 pages.
EnRoute 3, User's Manual, Sep. 1, 2004, 270 pages.
ArtCAM Pro, Basic Training Instructor Example Book 64 pages.
ArtCAM Pro, Basic Training, Student Workbook, 43 pages.
www.cnczone.com/forums/vectric/16905-photovcarve.html, Aug. 2, 2011, 6 pages.
ArtCAM Case Study—Lithophanes, Lithophanes—Return from the dead, Aug. 2, 2011, 2 pages.
Duct User, New Roughing Module, 1 page Jun. 1994.
Using ArtCAM Pro to create 3D Lithophane models (back lit Embossed), ARTCAME User Group Meetings, Sep. 2000, 6 pages.
ArtCAM Pro, Case Study—Thomas Telford School Totally Terrific Technology Tasks, Sep. 11, 2001, 3 pages.
Face Wizard Tips and Tricks, 6 pages.
VS3D Image Embossing/Engraving Tutorial, Feb. 21, 2005, 8 pages.
VS3D Image Embossing/Engraving Tutorial, Aug. 10, 2004, 8 pages.
Virtual Sculptor, 2003, 3 pages.
Type3 V 4.2—User's Guide—Preliminary Release, 333 pages, 1991.
Trigard Engraved Bronze, 4 Easy Steps Custom, Aug. 23, 2012, 2 pages.
The Place 4 Pets, Pet Urns, Feb. 5, 2005, 2 pages.
Trigard Bronze, Pet Memorials, Nov. 10, 2005, 2 pages.
Trigard Engraved Bronze, May 19, 2004, 1 page.
Trigard Trophy Plaques, May 6, 2005, 2 pages.
Trigard Bronze, Corporate Plaques, Nov. 10, 2005, 2 pages.
Trigard Engraved Bronze, Some Helpful Hints on Preparing Your Order, 2 pages.
Trigard Bronze, Design Your Plaque, Nov. 10, 2005, 2 pages.
Trigard Engraved Bronze, Creating Your Project, Aug. 25, 2005, 1 page.
Bronze Plaque The March to The Arch, Engraved Bronze, 2005, 1 page.
Bronze Plaque The March to The Arch, Source Image, 2005, 1 page.
VCarve Pro & PhotoVCarve Video Tutorials & Documents, Jul. 8, 2006, 4 pages.
The ArtCAM Quarterly, Tips and Tricks, Jun. 24, 2005, 2 pages.
The ArtCAM Quarterly, Case Study—Carve 3D, Jun. 24, 2005, 2 pages.
The ArtCAM Quarterly, Case Study—The Alternative Jewelry Shop, Jun. 24, 2005, 2 pages.
ArtCAM, What's New in ArtCAM JewelSmith 7.1?, Jan. 26, 2005, 16 pages.
Where Do I Start? What is Available? How Do I Choose What is Right for Me? 2pages.
Delcam ArtCAM Forum, Aug. 2, 2011, 11 pages.
Machining Lithophanes with PhotoVCarve, Tutorial 2 Getting Stated Vectric, 13 pages.
Midas Black/Brown Patina. RioGrande.com order page printed Oct. 8, 2009.
The Basics of Manufacturing Technology, EE498—Professor Kelin J. Kuhn, Printed Jul. 12, 2005 from Washington.edu.
News-delcam: News, views, and updates from the world cadcam, Delcam.com Issue 3 2006 16 pages.
http://www.artcam.com, ArtCAM Proo 3D Design Software, ArtCAM Jewel Smith, ArtCAM Insignia, 2 pages, 1993.
http://www.adobe.com/products/photoshop, adobe photoshop, 4 pages, Dec. 20, 2006.
http://www.zcorp.com, The Fastest way to Create Physical Color Models From CAD Data, 1 page, Dec. 20, 2006.
http://www.zcorp.com/whatwedo.asp, Setting the Standard for Fast, Affordable, Color 3D Printing, 2 pages, Dec. 20, 2006.
http://www.ece.gatech.edu/research/labs/vc/theory/photoith.html, Photolithography, 5 pages, Dec. 20, 2006.
Trigard Engraved Bronze, Some Helpful Hints on Preparing Your Order, 2 pages (date unknown).
Where Do I Start? What is Available? How Do I Choose What is Right for Me? 2pages (date unknown).
Machining Lithophanes with PhotoVCarve, Tutorial 2 Getting Stated Vectric, 13 pages (date unknown).
Kern http://www.kernlasers.com/3d_laser_engraving.htm, 2 pages (Dec. 12, 2012).
Gantry Gallery Graygraphics http://gantryco.com/index.htm, 2 pages (Dec. 12, 2012).
ArtCAM Pro, Basic Training Instructor Example Book 64 pages (date unknown).
ArtCAM Pro, Basic Training, Student Workbook, 43 pages (date unknown).
Face Wizard Tips and Tricks, 6 pages (date unknown).

METHOD FOR MANUFACTURING A CAST PRODUCT HAVING A PHOTOGRAPHIC RELIEF IMAGE; AND, CAST PRODUCT

This application claims priority to U.S. Application Ser. No. 61/467,702 that was filed with the United States Patent and Trademark Office on Mar. 25, 2011. The entire disclosure of U.S. Application Ser. No. 61/467,702 is incorporated herein by reference.

TECHNICAL FIELD

This disclosure relates to a method for manufacturing a cast product having a photographic relief image, and a cast product having a photographic relief image therein. The cast product can be prepared by casting a metallic material in a mold created by a pattern, wherein the pattern has a photographic relief image therein created by a laser. The cast product can include a photographic relief image exhibiting a true resolution corresponding to at least 80 dots per inch (dpi).

BACKGROUND

A sculpture generally refers to a three-dimensional art work. Sculptures have been made in various materials. A particular type of sculpture can be referred to as bas-relief or low relief. In general, a bas-relief or low relief is a type of sculpture where the image projects from a background and has a shallow overall depth. Bas-reliefs or low reliefs are often prepared by removing background material, and examples of bas-reliefs are very common. Examples of bas-reliefs or low reliefs that are made by a technique other than removing background material include coins. Modern coins are typically prepared by stamping or coining.

There have been recent attempts to produce photographic images in relief in metallic materials such as bronze. While photographic images in relief can be considered a type of bas-relief or low relief, photographic images in relief are different because they are generated from a photograph or photographic image and are provided to mimic or replicate the photograph or photographic image, utilize a tight relief depth range, and provide shading corresponding to location in the relief depth to create a photographic look. Furthermore, photographic relief images are typically prepared in a "one-off" situation. That is, photographic relief images are typically not mass produced.

One area in which photographic images are introduced into a metallic material is the area of memorial products. One technique for introducing a photographic image into a metallic material involves utilizing a CNC machine to route an image based upon a photograph into the surface of a bronze plaque to create a memorial product. See U.S. Pat. No. 6,950,713 to Walthall. Other techniques involve using a CNC machine to route a relatively softer material that can be used as a pattern for creating a mold in sand, and then casting a bronze plaque using the mold. See U.S. Pat. No. 7,814,959 to Karenbauer and U.S. Patent Publication No. US 2008/0148539 to Shepherd et al. U.S. Patent Publication No. US 2008/0148539 to Shepherd et al. appreciate the desirability of providing a tight relief depth range and small relief depth in order to more closely mimic or replicate the photographic image. These techniques that utilize a CNC router are limited in their ability to achieve a resolution or crispness of image that corresponds to the smallest router bit that can be used to remove the material. When following these techniques that utilize a CNC router, one must compromise between the resolution or clarity of the image and the speed of the process.

Using a very small router bit (for example, a router bit having a bit width of 0.0312 inch (1/32 inch) or smaller) may be impractical because of the length of time necessary to create the image in the bronze or pattern material. Furthermore, because the router bit contacts the bronze or pattern material, it is necessary to periodically sharpen or replace the router bit which contributes to additional expense. Even when using a router bit having a very small bit width, the resolution or clarity is still limited. Furthermore, the speed at which a router bit can route a surface is limited by considerations such as the stress and wear. Under too much stress, a router bit may bend resulting in loss of clarity. Furthermore, too much stress may cause a router bit to heat up and where out thereby requiring replacement or sharpening.

Lasers have been used to create sculptures. Often, the sculptures are in the form of signage. For example, see U.S. Pat. No. 4,126,500 to Palanos and US Patent Publication No. US 2003/0019135 to Luckenbaugh. Lasers have been used in sub-surface laser engraving. See U.S. Pat. No. 6,605,797 to Troitski. Lasers have additionally been used to create images as a result of pitting a material such as stone. For example, see U.S. Patent Publication No. US 2008/0160254 to Arnold. These pitted stone products, however, do not exhibit a relief depth sufficient to create a mold for casting a metallic material in order to provide the image on the cast metallic material.

SUMMARY

A method for manufacturing a cast product having a photographic relief image thereon is disclosed. The method includes steps of capturing a photographic image as a digital grayscale image, converting the digital grayscale image to a series of instructions for operating a laser engraving machine; laser engraving a pattern material to provide a pattern having a photographic relief image therein corresponding to the digital grayscale image and having a relief depth of about 0.030 inch to about 0.080 inch, wherein the relief depth refers to the maximum relief distance within the photographic relief image, and wherein the photographic relief image exhibits a true resolution corresponding to at least about 80 dpi; creating a mold cavity in sand using the laser engraved substrate; and casting a metallic material in the mold cavity to provide a cast product having the photographic relief image therein.

A cast product is disclosed. The cast product is provided having a photographic relief image therein having a relief depth of about 0.030 inch to about 0.080 inch, wherein the relief depth refers to the maximum relief distance within the photographic relief image, and wherein the photographic relief image exhibits a true resolution corresponding to at least about 80 dpi.

DETAILED DESCRIPTION

Figure 1:
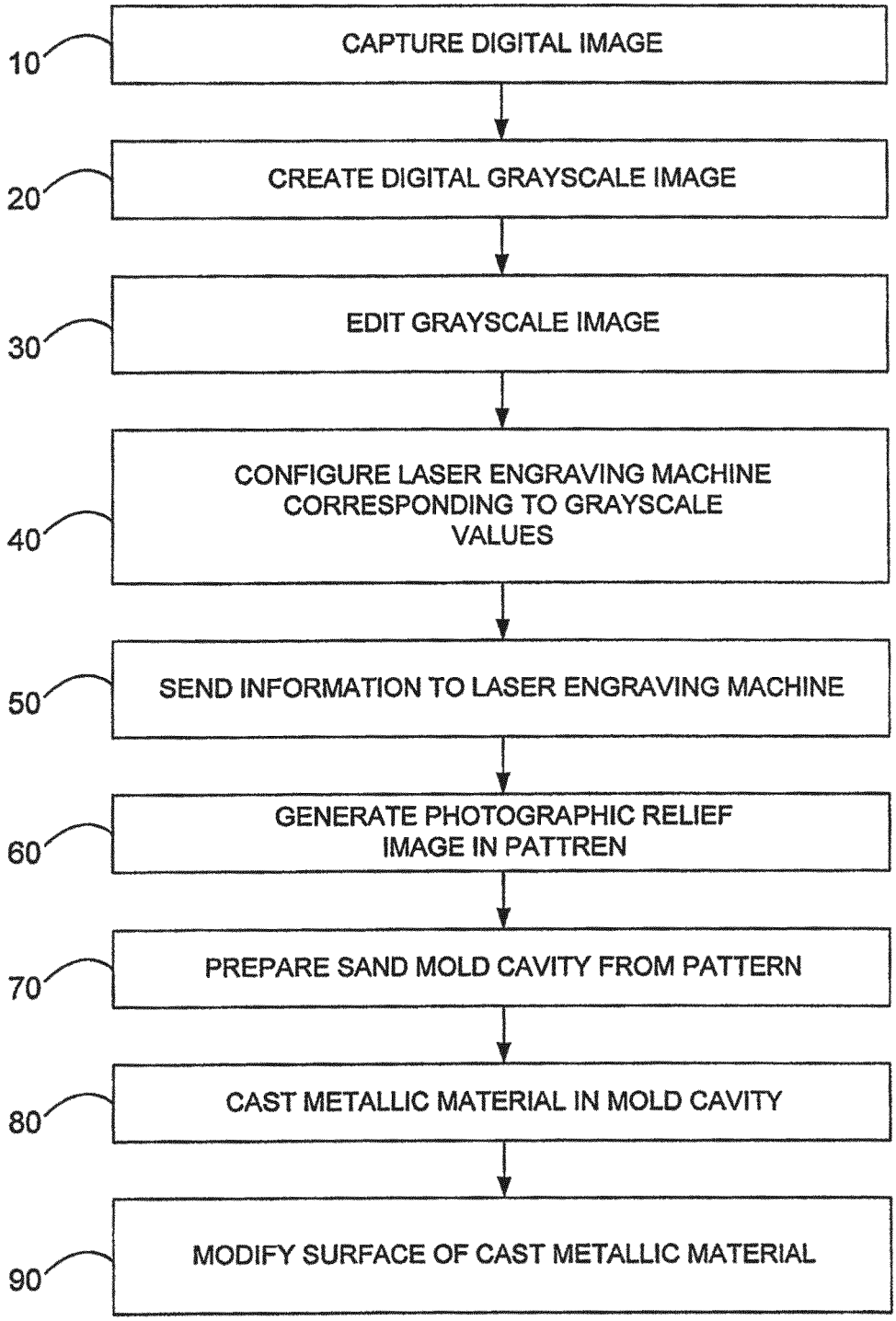
FIG. 1 shows a process flow diagram for making a cast product having a photographic relief image therein according to the principles of the invention.

A method is provided for manufacturing a cast product having a photographic relief image therein. The cast product can be a memorial product, a sign, a plaque, or any other type of cast product for display that includes a photographic relief image created by casting. In general, a memorial product is something that contains personalized information commemorating or memorializing someone or something or some event. A cast memorial product is typically cast using, for example, a metallic material such as bronze. A metallic material provides durability, and bronze is aesthetically pleasing. In addition, bronze can provide a surface oxidation that helps draw out the contrast in height within the photographic relief image to help create a photographic look. Other metallic materials can be used. A sign can be considered any type of display intended to provide or convey information. A plaque includes any type of decorative, honorary, ornamental, or commemorative product. Whether the cast product is a memorial product, a sign, or a plaque, the cast product can include a photographic relief image thereon wherein the photographic relief image is created as a result of casting. The cast product can include additional information such as words, numbers, symbols, or decorative information in addition to the photographic relief image. In addition, the other type of information can be provided separate and apart from the photographic relief image, or the other type of information can be provided superimposed on the photographic relief image. Furthermore, the cast product can include multiple photographic relief images that are provided as separate photographic relief images, a collage of photographic relief images, or a combination thereof.

A photographic relief image is a type of bas-relief having a relatively tight relief height so that the image resembles a photograph. The relief height is considered the distance in depth between the highest portion of the photographic relief image and the lowest portion of the photographic relief image. The highest portion of the photographic relief image corresponds to the lightest part of the photographic image from which the photographic relief image is derived, and the lowest portion of the photographic relief image corresponds to the darkest part of the photographic image from which the photographic relief image is derived. If the relief height is too small, the resulting image may include insufficient detail so that the image does not sufficiently resemble a photograph. If the relief height is too large, the resulting image may have features that look unnatural and the image may not look like a photograph. The reference to a photograph should be understood to include analog and digital photographs. Digital photographs can be referred to as digital images. For purposes of creating a photographic relief image, any analog photograph can be converted to a digital image by, for example, digitally scanning the analog photograph. To provide a realistic photographic appearance, the photographic relief image can have a relief depth of about 0.030 inch to about 0.080 inch, and preferably about 0.040 inch to about 0.070 inch or about 0.040 inch to about 0.060 inch. While these ranges are desirable, the relief height can be provided at a value as low as about 0.01 inch if one is willing to accept a lack of detail, and up to about 0.12 inch if one is willing to accept greater depth. The photographic relief image can be referred to as the "image" for simplicity.

It should be appreciated that the term "about" when used in the context of a numerical value refers to the value including an acceptable range of error depending on how the value is measured. In addition, it should be understood that each value can be presented, if desired, without the word "about."

Now referring to FIG. 1, an outline of exemplary steps for manufacturing a cast product having a photographic relief image therein is provided. The steps include a step 10 of capturing a digital image. The image may be captured in a variety of methods known in the art, such as by creating an image with the use of a digital camera, by scanning a photograph, or by importing a digital image. In the case of a memorial product for a deceased person, the photograph may be a relatively old photograph in the case of relatively older person, and the photograph may be one from a significantly earlier time in the person's life. Alternatively, the photograph can be of relatively recent origin. For example, the person may have died at a relatively young age. In any event, capturing a digital image includes importing the digital image into a medium where it can be digitally manipulated. The image may be imported and stored on a computer. The initial digital image can be edited, if desired. Editing can include combining multiple images together, and editing can include creating clarity, contrast, or a combination thereof to improve the ultimately produced photographic relief image. The image can be provided, as a single image or as a collage of images. In general, a single image can be considered an image from a single photograph. A collage can be considered a compilation of two or more photographs. The image that is captured and available for digitally manipulating can be referred to as the initial digital image, and can be provided as a single image or as a collage of images.

The initial digital image can be converted to a digital grayscale image by step 20. This step is optional because the initial digital image may already be a grayscale image. In general, a grayscale image lacks color, and can be considered a monochromatic representation in which each pixel within the image is assigned an intensity value ranging from white to black. The contrast in the image is a result of the variation in shading. The number of shades in the image is a function of the resolution with which the image is created. For example, an 8-bit image can have 256 levels of intensity or shades of gray. The grayscale value assigned to each pixel in the image can be used to indicate to a laser engraving machine how much laser power should be generated based on that grayscale value.

The grayscale image can be edited in a step 30 to create an edited grayscale image. Because the edited grayscale image will be used to indicate to a laser engraving machine how much laser power should be generated based on each grayscale pixel value, certain edits can help enhance contrast. Enhancing contrast can help introduce contrast depth into the image and provide separation between features. One example of where this type of editing may be helpful is to add contrast to blonde hair washed out by sunlight. The editing process can additionally include the removal of features from the image that are undesirable in the finished product such as the background behind the primary subject of the image. Exemplary undesirable features common in portrait photographs are hot spots or shiny areas on the subject's skin caused by strong light reflections or by sweating. One skilled in the art will also appreciate that features can also be replaced and/or added to the image to create an edited digital image.

Character information such as lettering, numbering, or both lettering and numbering can be introduced into the cast product. In general, the character information includes words and dates that convey information separate from the photographic relief image. Exemplary character information includes epitaph information, dates of birth and death, quotations, honorary information, description, etc. The character information can be provided so that it does or does not form part of the photographic relief image. When the character information is not intended to be part of the photographic relief image, it can be provided having a relief depth outside the relief depth range provided for the photographic relief image. In general, when the character information is not part of the photographic relief image, it can be provided so that there is sufficient contrast between the character information and the photographic relief image so that the character information does not look like part of the photographic relief image. In such a situation, it should be appreciated that the character information can be provided within or outside of the photographic relief image. Alternatively, the character information can be provided as part of the photographic relief image. In such a situation, the character information can be provided having a relief height that is within the relief height of the photographic relief image. In addition to character information, symbols and designs can be added, as desired. The symbols and designs can be treated in the same way that character information can be treated. In addition, character information, symbols and designs can be added to a pattern as relief, for example, extending away from the outermost surface of the pattern. For example, they can be applied to the outermost surface of the pattern.

The editing step 30 can be performed in image manipulation software, such as ADOBE PHOTOSHOP® or a similar program. Once the image is imported into the image manipulation software, edits to the image can be accomplished with the editing tools available in the software. The image manipulation software can create the grayscale image. Once the editing process is complete, the edited grayscale image is ready to be uploaded to a laser engraving machine in a subsequent step 40.

The step 40 includes configuring a laser engraving machine to use a laser to create an image in a pattern material that corresponds to the photographic relief image. The laser engraving machine can be one having a sufficiently high power rating so that it can operate at high speeds to vaporize portions of the pattern material. For example, an exemplary laser engraving machine that can be used includes a laser engraving machine rated at 400 watts. One example of a laser engraving machine and associated software suitable for the disclosed process is the HSE Laser Engraving System manufactured by Kern Laser Systems of Wadena, Minn.

The configuration step 40 provides that the desired relief height is obtained in the pattern as a result of the laser engraving machine. Relief height is the maximum distance between the highest portion and the lowest portion of the photographic relief image in the pattern. The relief height is important because the cast product will not provide a satisfactory photographic image if the relief height is either too small or too large. For example, if the relief height is too small, a sufficient level of contrast in the image will not be achieved. However, if the relief height is too large, the image may acquire an unrealistic quality with exaggerated features, such as sunken eyes in the case of a portrait. In some embodiments, a relief height below 0.030 inch may create a washed out appearance while a relief height greater than 0.080 inch may create an unnatural and unrealistic image. However, for some embodiments, a relief height of about 0.030 inch to about 0.080 inch can provide desirable results. The relief height can be provided as about 0.040 inch to about 0.060 inch.

The laser engraving machine can be configured to run at a percentage of maximum power intensity, speed, and resolution to provide a desired laser engraved product. With respect to power intensity, it is not necessary for the laser engraving machine to operate at maximum (100%) power. It may be desirable to provide a power intensity that is less than the maximum. For example, for a 400 watt laser engraving machine, it may be desirable to run at a power intensity of about 50% to about 90%. In addition, the speed at which the laser engraving machine operates and the desired ultimate resolution can be factors that can be taken into account when selecting the power intensity. The combination of operating power and speed may vary depending on the selection of the pattern material, the desired relief depth, and the time available to complete the engraving process. The range of laser power intensities can be selected from 0% power to 100% power (based upon the selected power intensity). The laser engraving machine can be configured so that a power range of intensity corresponds to grayscale value. For example, the laser engraving machine can be configured to generate 0% power for pure white pixels and 100% power for pure black pixels and to generate a corresponding fraction of maximum power for the gray pixels between black and white. If the laser engraving machine can process an 8-bit grayscale image, then the grayscale and power ranges can include 256 discrete values.

The desired detail and clarity of the photographic relief image can be achieved by selecting the laser beam diameter or spot size. In general, the spot size means the laser beam diameter and references the size at the point of contact. The point of contact refers to the location where the laser beam contacts the pattern material. Lenses can be used to generate the spot size or laser beam diameter. For standard lenses, a focal length of about 6 inches can correspond to a spot size of 0.011 inch and 90 dpi, a focal length of about 5 inches can correspond to a spot size of about 0.010 inch and 100 dpi, a focal length of about 4 inches can correspond to a spot size of about 0.008 inch and 125 dpi, a focal length of 3 inches can correspond to a spot size of about 0.006 inch and 167 dpi, a focal length of 2.5 inches can correspond to a spot size of 0.004 inch and 200 dpi, a focal length of 2 inches can correspond to a spot size of about 0.004 inch and 250 dpi, a focal length of 1.5 inches can correspond to a spot size of about 0.003 inch and 333 dpi, a focal length of 1 inch can correspond to a spot size of 0.002 inch and 500 dpi, and a focal length of 0.75 inch can correspond to a spot size of 0.001 inch and 1,000 dpi. It should be appreciated that any of these lenses can be used to create the desired spot size or dpi, and the desired spot size or dpi can be selected to provide the desired detail and clarity. For example, it may be desirable to use a 6 inch focal length to provide at least 80 dpi. It may be desirable to provide at least 100 dpi, at least 150 dpi, at least 200 dpi, or at least 250 dpi to provide the desired detail and clarity. At a certain point, the extra detail may become difficult to discern. For many applications, the maximum dpi can be 1,000.

The laser beam can provide a photographic relief image in the pattern material exhibiting a true resolution corresponding to at least 80 dpi. The term "true resolution" refers to the resolution created when there is no laser beam overlap. The reference to "true resolution" can be considered theoretical because it is expected that there will be some level of overlap and it is probably too difficult to provide absolutely no overlap yet provide perfect removal of all material between adjacent laser beams. For practical purposes, the resolution of the photographic relief image can be referred to in terms of "true resolution." Preferably, the photographic relief image exhibits a true resolution corresponding to at least 80 dpi. By way of example, a laser beam can have a spot size of about 0.005 inch and provide a sufficiently quick cut time at about 200 dpi. Results may be more desirable when the true resolution is at least 300 dpi, and may be more desirable in certain circumstances when the true resolution is at least 500 dpi. In contrast, a CNC router that utilizes a 3/32 inch diameter bit (0.0937 inch) is capable of routing to a resolution that is the equivalent of about 10 dpi. A 1/16 inch diameter bit (0.0625 inch) is capable of routing to a resolution that is the equivalent of about 16 dpi, a 1/32 inch diameter bit (0.03125 inch) is capable of routing to a resolution that is the equivalent of about 32 dpi, and a 1/64 inch diameter bit (0.015625 inch) is capable of routing to a resolution that is the equivalent of about 64 dpi. This is because the obtainable true resolution can only be as fine as the width of the tool or beam being used to create the hole in the relief. Although some amount of beam overlap (also referred to as "overburn") can be realized when using a laser, the amount can be negligible when comparing resolution resulting from a laser process to resolution resulting from a router process. A laser beam having a diameter of 1/325 inch (0.003 inch) is capable of providing a resolution that is the equivalent of about 325 dpi, a laser beam having a diameter of 1/200 inch (0.005 inch) is capable of providing a resolution that is the equivalent of about 200 dpi, and a laser beam having a diameter of 1/142 inch (0.007 inch) is capable of providing a resolution that is equivalent of about 142 dpi. A laser beam having a diameter of less than 0.003 inch can be used, but it is found that it may provide too fine detail that is difficult to reproduce with conventional sand casting techniques. Accordingly, the laser beam spot size can be selected from about 0.001 inch to about 0.012 inch to provide desired resolution, and preferably about 0.003 inch to about 0.01 inch.

The configuration step 40 involves selecting the power, speed, and desired resolution for the resulting photographic relief image in the pattern material. The configuration of the laser engraving machine in step 40 is at least partially a function of the selection of the pattern material. The pattern material is selected based on how it responds to the laser beam from the laser engraving machine. Because the laser engraving machine is unable to monitor the level of hardness or softness in a material and how it changes over the length, width, and depth of the material, it is generally desirable for the material to have a relatively consistent hardness across the length, width, and depth of the material. Examples of materials having hard and soft regions include grained wood (grained wood refers to wood having wood grain running there through), and some extruded plastic materials. Extruded plastics tend to have streaks from extrusion or casting as a result of the alignment of polymer molecules induced, for example, by the stresses involved in extrusion. The existence of streaks in certain plastics may cause the plastics to exhibit softer or harder regions and that can effect the quality of the resulting photographic relief image in the pattern material. In addition, the material should respond well to the heat of the laser beam. Materials that melt and flow excessively without complete vaporation when subjected to the heat of a laser beam are generally not desired. Furthermore, materials that buckle or warp excessively when lasered are generally not desired. Preferred materials include those that burn away when subjected to the heat of the laser beam without deforming the material below or around the laser beam. In addition to buckling or warping, another type of deformation created by a laser beam can include the movement of material to the surface under the heat of the laser beam. An example of this can be adhesives. Certain adhesives may have a tendency to flow toward the hot area created by the laser beam. It is generally desirable to avoid this type of movement of adhesives because it may have a tendency to affect the surface of the pattern. Another undesirable issue with many materials is that they do not react well to the heat of the laser beam and therefore do not vaporize well enough to leave a smoothly engraved surface. This is true for some composite materials having certain types of adhesives because the adhesive within the material can start to migrate to the surface under the influence of the laser heat. This is undesirable in a casting process because adhesive on the surface of the pattern can cause sand from the mold cavity to stick to the pattern, thereby compromising the quality of the mold cavity. The problem of movement of adhesive toward the surface can be controlled, to a certain extent, by the technique of laser engraving. As explained in more detail below, multiple passes can be made by the laser engraving machine in order to reduce the effect that heat may have on the pattern material surrounding the area where the laser is applied. Exemplary materials that can be used for the pattern material include fiber boards or modeling materials (also referred to as model and tooling board). In general, fiber boards include fibers and adhesives holding the fibers together. An exemplary fiber board includes a material that is often referred to as hardboard. An exemplary hardboard material is available under the name MASONITE. In general, modeling materials can include filled plastic materials. An exemplary filled plastic material includes filled thermosetting materials, and filled acrylic materials, and cured polyurethane. In general, any type of material can be used as the pattern material provided that it can handle the heat of the laser beam without providing undue distortion to the pattern material, and that portions of the material can disintegrated as a result of application of the laser beam without adversely effecting the surrounding areas, and that the consistency of the material is sufficiently consistent so that a desired photographic relief image can be created. An exemplary modeling material that can be used is available under the name MB2001 Model & Tooling Board from BCC Products, Inc.

In order to minimize the effect that the heat of the laser beam can have on the pattern material, the step of laser engraving can be provided by multiple passes. For example, a first pass over a particular area of the pattern material can remove a particular amount of pattern material. A second or third pass, for example, can be applied to the same location once the heat has dissipated in order to remove more material. By providing multiple passes, adjacent areas can be controlled to help minimize the possibility of adverse consequences resulting from overheating adjacent areas. Furthermore, the use of multiple passes allows for ash to be removed from the pattern surface. Ash refers to the carbonaceous material resulting from essentially burning the pattern material by application of the laser beam. The presence of ash can interfere with the ability of the laser beam to heat a particular area of the pattern material. For example, part of the heat of the laser beam may be applied to the residual ash rather than the pattern material. Accordingly, it is desirable to remove the ash material from the pattern as soon as it has been created.

Once the laser engraving machine has been configured, the edited grayscale image can be sent to the laser engraving machine in step 50. One skilled in the art will appreciate that this step 50 can occur concurrently with or prior to the configuration process step 40. Additionally, where the image is edited on a system associated with the laser engraving machine, then it is not necessary to send the edited image in a discrete step 50 as the image already exists within the system.

Once a pattern material has been selected and the laser engraving machine configured, the pattern having a photographic relief image therein can be generated in step 60. This step can include a single pass or multiple passes by the laser engraving machine over certain areas where the photographic relief image is formed. Based on the type of material selected for the pattern, it is sometimes advantageous to make multiple passes with the engraving machine rather than to attempt engraving the pattern to its finished relief height in one step. Where multiple passes are used, the laser engraving machine can be configured for each individual step such that material removal occurs as desired. Furthermore, a multiple pass approach allows for the pattern to be cleaned, such as by compressed air or vacuum, between each pass. Once the pattern has been fully engraved, it may be desirable to remove loose fibers and to smooth the pattern surface so that the desired image is obtained. This step can be done by hand, and care should be taken to make sure that detail created by the laser is not lost. The laser engraving machine can be configured for the pattern material so that the material being removed from the pattern is largely vaporized thereby minimizing the need for extensive post-engraving finishing of the pattern. After the engraving and finishing process is complete, it may also be desirable to coat the surface of the pattern material with a release agent so that sand does not stick to the pattern during the step of preparing a mold 70.

The pattern material can be provided as a material having a thickness of less than about 0.25 inch. For example, the thickness of the pattern material can be about ⅛ inch. Because the relief depth is so small, it is only necessary for the pattern material to have a thickness sufficient to accommodate relief depth and maintain dimensional stability. Furthermore, the created pattern having a photographic relief image therein can be placed in a frame where it is then used to create the mold cavity. The frame can include a recess for receiving the pattern, and can include character information, symbols, or asthesthetic designs.

Once the pattern is engraved and finished, an inner cavity of a mold is created at step 70. The pattern is placed into a mixture of fine silica, sand, and resin, which is then packed around the pattern. For example, 90 grain silica sand can be used to cover the pattern. Once the components are placed together, the sand mixture is then allowed to harden; thereby forming a mold with the pattern defining and forming the inner cavity that will then be cast. As a result, the inner cavity of the mold includes the photographic relief image. The sand mold is then separated so that the pattern can be removed, and then the sand mold is reassembled so that the inner cavity of the mold can be used for casting. It should be appreciated that other types of sand molding can be utilized including the techniques know to those skilled in the art.

In a subsequent step 80, a casting is made from the mold cavity by pouring a molten material, such as a bronze alloy, into the inner cavity of the mold and allowing the material to harden. Typically, runners are incorporated into the mold to help facilitate pouring the molten material in to the mold. Once the material hardens, thereby forming the rough casting, the rough casting will include the photographic relief image and information that is contained on the inner cavity of the mold.

The material used for forming the cast product can be bronze. In general, bronze typically includes at least about 50% by weight copper. In one example of bronze for use as a memorial product, the copper component is provided in an amount of about 87% by weight or higher. It should be appreciated, however, that various types of materials can be processed by the invention. Bronze does provide a high degree of longevity in many applications.

Once the rough casting is formed, the casting surface can be modified at step 90. The casting can be cleaned using, for example, an abrasive tool. For example, the rough casting can include small amounts of sand from the mold, and that sand can be removed. Small raised areas on the rough casting may be present and can be carefully removed with an abrasive material, such as sand paper. The cleaning process is a delicate process and can be done by hand so that only the small raised areas and rough spots are removed by hand rubbing the abrasive material over these areas to avoid damaging the photographic relief image. After cleaning, the casting can be prepared by an abrasive blast or by chemical cleaning for exposure to an oxidation chemical, and subsequently exposed to an oxidation bath. The oxidation bath may include an oxidization colorant, such as a mixture of brown patina and black patina.

Other surface modifications can include removing the oxidization from high spots of the surface of the casting to allow for the illusion of more depth in the surface which accentuates the photographic relief image. Removing oxidation on the heightened features can be accomplished with an abraiding material. Exemplary materials that can be used a wire brush, a metallic wool pad, or a fibrous abrasive pad such as a 3M SCOTCH BRITE Pad. The casting can also be coated with a clear coat to preserve the photographic relief image. The clear coat is applied to protect the bronze from further oxidation. A gloss or matte clear coat finish can also function to produce a sharper image and help the photographic features surface stand out.

Figure 2:
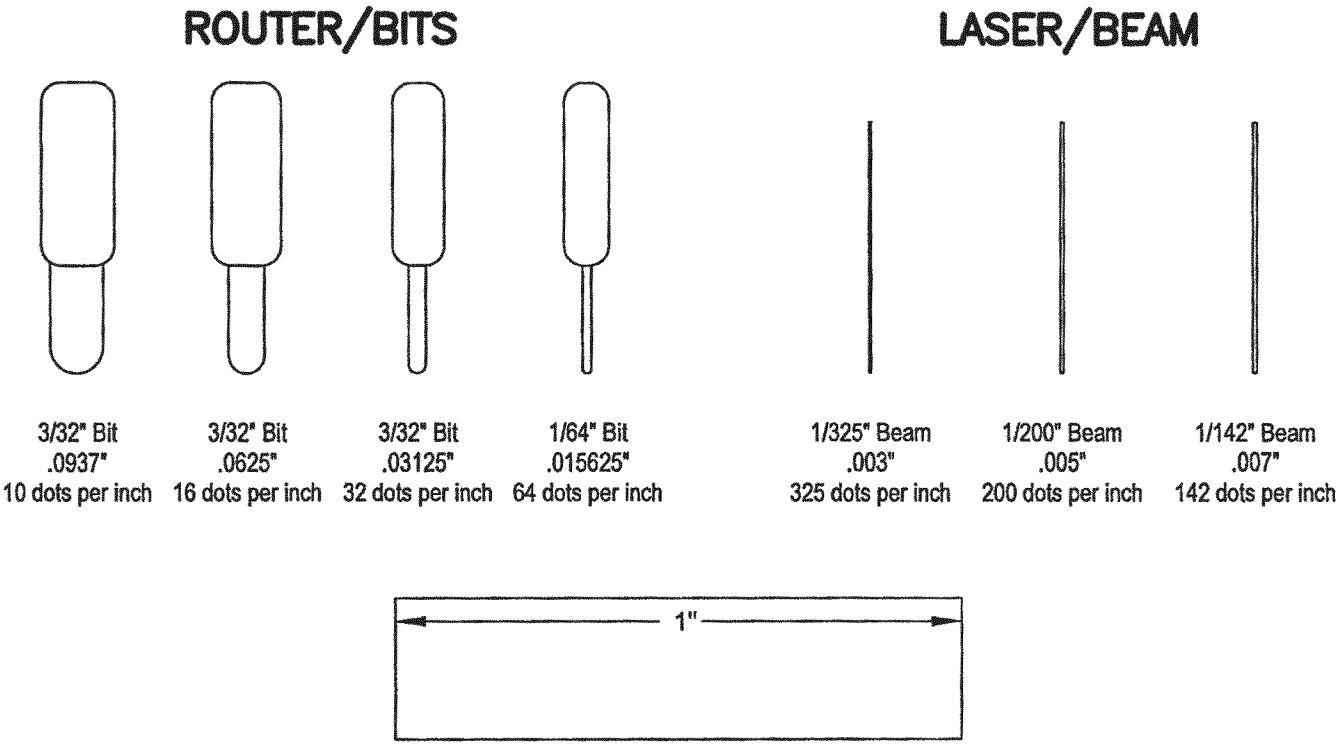
FIG. 2 compares relative diameters of router bit blades and laser beams.

Now referring to FIG. 2, a scaled comparison is shown depicting several exemplary router bit diameters and several exemplary laser beam diameters to show relative sizes, and help illustrate how the sizes effect clarity or resolution. The indicated box represents a scale corresponding to 1 inch. The diameter of the router bits and the laser beams are scaled to the box. The router bits have a blade end that can be referred to as ball nose or conical. A straight end on a router bit would have a tendency to decrease clarity or resolution. In contrast, the laser beam can be considered as having a straight edge but, because of the smaller diameter, clarity and resolution can be enhanced. Furthermore, the "cut" of the laser beam can be controlled by the intensity of the laser beam.

The laser engraving process for creating photographic relief image in a pattern can be significantly faster, while providing significantly improved resolution, compared to a routing process for creating the same photographic relief image. It is interesting to compare the length of time it would take the router bits and the laser beams to create a pattern having a photographic relief image therein at a size of 4 inches by 5.75 inches at a maximum relief depth of 0.0625 inch (1/16 inch). The 1/200 inch diameter laser beam can achieve a pattern having photographic relief image therein in about 30 minutes, and can provide a very high resolution corresponding to 200 dpi. In contrast, the 3/32 inch diameter router bit takes 90 minutes to produce the same size pattern having a photographic relief image therein at a resolution of about 10 dpi. The 1/16 inch diameter router bit takes about 150 minutes to provide a pattern having a photographic relief image therein at a resolution that is the equivalent of about 16 dpi. The 1/32 inch diameter bit takes about 2.40 minutes to provide a pattern having a photographic relief image therein at a resolution that is the equivalent of about 32 dpi. The 1/64 inch diameter bit takes about 345 minutes to provide a pattern having a photographic relief image therein at a resolution that is the equivalent of about 64 dpi. Clearly, laser engraving is significantly faster compared to routing and achieves much higher resolution. For example, the 1/200 inch diameter laser beam takes 30 minutes and achieves a resolution that is an equivalent of 200 dpi wherein the 3/32 inch diameter router bit takes three times as long and only achieves a resolution that is the equivalent of 1/20 of the clarity achieved by the 1/200 inch diameter laser beam. The laser engraving process can be characterized as providing a photographic relief image in a pattern and having a relief depth of about 0.030 inch to about 0.080 inch in less than half the time and at greater than twice the resolution (defined by dpi) compared to the routing process.

There are at least a couple reasons why the laser engraving process can be faster than the routing process. One reason is that a laser process is not limited by the need to physically contact a material which is required when routing. The requirement of physical contact has the effect of limiting the movement of the router bit to a speed that does not create too much stress on the router bit. Too much stress on the router bit can be exhibited by an undesirable level of bending of the router bit resulting in a loss of clarity or resolution, an undesirable cut in the pattern material, or an increased rate of wear of the router bit requiring a more frequent sharpening or replacement of the router bit. Another reason why the laser engraving process can be faster than the routing process is that the routing process requires the router to travel both horizontally and vertically to create or three-dimensional relief.

Although specific embodiments have been illustrated and described herein, it will be appreciated by those of ordinary skill in the art that a variety of alternative and/or equivalent implementations may be substituted for the specific embodiments shown and described without departing from the scope of the present invention. The application is intended to cover any adaptations or variations of the specific embodiments discussed herein. Therefore, it is intended that this invention be limited only by the claims and the equivalents thereof.

We claim:

1. A method for manufacturing a cast product having a photographic relief image therein, the method comprising:

(a) capturing a photographic image as a digital grayscale image;

(b) converting the digital grayscale image to a series of instructions for operating a laser engraving machine;

(c) laser engraving a pattern material using the series of instructions to provide a laser engraved substrate having a photographic relief image therein corresponding to the digital grayscale image and having a relief depth of about 0.030 inch to about 0.080 inch, wherein the relief depth refers to the maximum relief distance within the photographic relief image, and wherein the photographic relief image exhibits a true resolution corresponding to at least about 80 dpi;

(d) creating a mold cavity in sand using the laser engraved substrate; and (e) casting a metallic material in the mold cavity to provide a cast product having the photographic relief image therein.

2. A method according to claim 1, further comprising digitally editing the digital grayscale image.

3. A method according to claim 1, further comprising digitally editing a digital image to provide an edited digital image and then converting the edited digital image to the digital grayscale image.

4. A method according to claim 1, wherein the step of laser engraving comprises laser engraving to provide the photographic relief image having a true resolution corresponding to at least about 100 dpi.

5. A method according to claim 1, wherein the step of laser engraving comprises laser engraving to provide the photographic relief image having a true resolution corresponding to at least about 200 dpi.

6. A method according to claim 1, wherein the step of laser engraving comprises providing a laser beam having a spot size of less than a diameter of less than 0.012 inch.

7. A method according to claim 1, wherein the pattern material comprises a fiber board substrate.

8. A method according to claim 7, wherein the fiber board substrate comprises a mixture of fiber and adhesive.

9. A method according to claim 1, wherein the pattern material comprises a filled polymer material.

10. A method according to claim 1, wherein the pattern material has a thickness of less than about 0.25 inch.

11. A method according to claim 1, wherein the step of laser engraving comprises multiple passes of a laser beam over the pattern material to provide the having the photographic relief image therein.

12. A method according to claim 1, wherein the step of laser engraving comprises laser engraving to a relief depth of about 0.040 inch to about 0.060 inch.

* * * * *